US010706798B2

(12) United States Patent
Shan

(10) Patent No.: US 10,706,798 B2
(45) Date of Patent: Jul. 7, 2020

(54) DISPLAY DRIVING METHOD, DEVICE AND APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 220 days.

(21) Appl. No.: 15/751,545

(22) PCT Filed: Dec. 8, 2017

(86) PCT No.: PCT/CN2017/115165
§ 371 (c)(1),
(2) Date: Feb. 9, 2018

(87) PCT Pub. No.: WO2019/071776
PCT Pub. Date: Apr. 18, 2019

(65) Prior Publication Data

US 2020/0020287 A1 Jan. 16, 2020

(30) Foreign Application Priority Data

Oct. 10, 2017 (CN) ..... 2017 1 0935847

(51) Int. Cl.
*G09G 5/10* (2006.01)
*G09G 3/36* (2006.01)

(52) U.S. Cl.
CPC ..... *G09G 3/3648* (2013.01); *G09G 3/3607* (2013.01)

(58) Field of Classification Search
CPC ..... G09G 2360/16; G09G 2310/0272
See application file for complete search history.

(56) References Cited

U.S. PATENT DOCUMENTS

2003/0107681 A1 6/2003 Otawara et al.
2006/0097971 A1 5/2006 Lee et al.
(Continued)

FOREIGN PATENT DOCUMENTS

CN 101345036 A 1/2009
CN 102044222 A 5/2011
(Continued)

OTHER PUBLICATIONS

Shan, International Application No. PCT/CN2017/116323, filed on Dec. 15, 2017 and English Translation thereof.
(Continued)

*Primary Examiner* — Nan-Ying Yang
(74) *Attorney, Agent, or Firm* — Kagan Binder, PLLC

(57) ABSTRACT

The present disclosure relates to a display driving method, device and device, an original gray scale data group of the pixel units in the preset display area and of the content to be displayed is acquired; average gray scales of each of the hues in the preset display area are determined according to the original gray scale data group; original light source intensities of the hues in the preset display area and of the content to be displayed are acquired; the original gray scale data group is divided into a first gray scale data group and a second gray scale data group and the driving light source intensities of each of the hues in the preset display area are determined according to the original gray scale data group of the pixel units, the average gray scales of each of the hues, and the original light source intensities; the gray scales of each of the hues of the first gray scale data group are the maximal gray scale in the original gray scale data group; the gray scales of each of the hues of the second gray scale data group are 0 or greater than the minimal gray scale of the original gray scale data group. The brightness difference between the hue of the low gray scale of the side view angle
(Continued)

and the hue of the overall pixel unit is reduced, such that the hue of the side view angle is presented close to the hue of the front view angle.

18 Claims, 6 Drawing Sheets

(56) References Cited

U.S. PATENT DOCUMENTS

| | | | | |
|---|---|---|---|---|
| 2006/0279522 | A1 | 12/2006 | Kurihara | |
| 2009/0167657 | A1 | 7/2009 | Tomizawa | |
| 2010/0104182 | A1 | 4/2010 | Gondek et al. | |
| 2010/0123401 | A1 | 5/2010 | Park et al. | |
| 2012/0206502 | A1* | 8/2012 | Jung | G09G 3/342 345/690 |
| 2013/0249973 | A1 | 9/2013 | Honbo | |
| 2014/0152724 | A1 | 6/2014 | Park et al. | |
| 2015/0206507 | A1 | 7/2015 | Kwon et al. | |
| 2015/0379942 | A1 | 12/2015 | Guo et al. | |
| 2016/0117975 | A1 | 4/2016 | Kang | |
| 2017/0154587 | A1 | 6/2017 | Chen et al. | |
| 2018/0114478 | A1 | 4/2018 | Tien et al. | |
| 2018/0144676 | A1* | 5/2018 | Nadershahi | G09G 3/2014 |
| 2020/0013351 | A1 | 1/2020 | Shan | |
| 2020/0020285 | A1 | 1/2020 | Shan | |
| 2020/0020286 | A1 | 1/2020 | Shan | |
| 2020/0027409 | A1 | 1/2020 | Shan | |

FOREIGN PATENT DOCUMENTS

| | | | |
|---|---|---|---|
| CN | 104299585 | A | 1/2015 |
| CN | 104517576 | A | 4/2015 |
| CN | 104794998 | A | 7/2015 |
| CN | 105096875 | A | 11/2015 |
| CN | 105528999 | A | 4/2016 |
| CN | 106228936 | A | 12/2016 |
| CN | 106873205 | A | 6/2017 |
| CN | 107103881 | A | 8/2017 |
| CN | 107154240 | A | 9/2017 |
| CN | 107657928 | A | 2/2018 |
| CN | 107808647 | A | 3/2018 |
| CN | 107808648 | A | 3/2018 |
| CN | 106057163 | B | 9/2018 |
| EP | 3168836 | A | 5/2017 |
| WO | 2017080299 | A1 | 5/2017 |

OTHER PUBLICATIONS

Shan, International Application No. PCT/CN2017/115246, filed on Dec. 8, 2017 and English Translation thereof.

Shan, International Application No. PCT/CN2017/115264, filed on Dec. 8, 2017 and English Translation thereof.

Shan, International Application No. PCT/CN2017/115289, filed on Dec. 8, 2017 and English Translation thereof.

English Translation for International Application No. PCT/CN2017/115289, dated Jul. 18, 2019, (2 pages).

First Chinese Office Action for Chinese Application No. 201710937006.5, dated Mar. 26, 2019 (8 pages).

International Search report for International Counterpart Application No. PCT/CN2017/115165, dated Apr. 27, 2018, (9 pages).

Chinese Office Action for Chinese Counterpart Application No. 201710935847.2, dated Mar. 8, 2019 (6 pages).

* cited by examiner

DISPLAY DRIVING METHOD, DEVICE AND APPARATUS

FIELD OF THE INVENTION

The present disclosure relates to the technology field of display, and particularly relates to a display driving method, device and apparatus.

BACKGROUND OF THE INVENTION

With the continuous development of science and technology, television, displayer and various other display devices are increasingly popular and are commonly equipped for residences, shopping malls, office buildings and other places that require information displaying, so as to facilitate the production or life of people.

However, in the color cast change of the side view and front view of various representative color schemes of a prior displayer, the side view color cast of schemes of red, green and blue is more serious over other color schemes, also, due to the fast saturation and escalation of the view angle brightness proportion of gray scale display, the front view brightness and side view brightness difference is greater as the gray scale is lower.

SUMMARY OF THE INVENTION

Accordingly, it is necessary to provide a display driving method, device and device that can address the problem of the side view color cast.

A display driving method includes:

acquiring an original gray scale data group of each of pixel units of a content to be displayed in a preset display area;

determining an average gray scale of each of hues in the preset display area according to the original gray scale data group;

acquiring an original light source intensity of each of the hues of the content to be displayed in the preset display area;

dividing the original gray scale data group into a first gray scale data group and a second gray scale data group according to the original gray scale data group of the pixel units, the average gray scales of each of the hues, and the original light source intensities, and determining the driving light source intensities of each of the hues in the preset display area; and the gray scales of each of the hues of the first gray scale data group are a maximal gray scale in the original gray scale data group; the gray scales of each of the hues of the second gray scale data group are 0 or is not a minimal gray scale of the original gray scale data group.

A display driving device includes:

an original gray scale acquiring module configured to acquire an original gray scale data group of each of pixel units of a content to be displayed in a preset display area;

an average gray scale determination module configured to determine average gray scales in the preset display area according to the original gray scale data group;

an original light source acquiring module configured to acquire original light source intensities of each of hues of the content to be displayed in the preset display area;

a gray scale group dividing module configured to divide the original gray scale data group into a first gray scale data group and a second gray scale data group according to the original gray scale data group of each of the pixel units, the average gray scales of each of the hues, and the original light source intensities, and determine the driving light source intensities of each of the hues in the preset display area; the gray scales of each of the hues of the first gray scale data group are a maximal gray scale in the original gray scale data group; and the gray scales of each of the hues of the second gray scale data group are 0 or greater than a minimal gray scale of the original gray scale data group.

A computer apparatus includes a memory, a processor and a computer program stored in the memory and executable on the processor, the processor executes the computer program to provide steps of the display driving method according to the foregoing method.

According to the display driving method, device and apparatus, the original gray scale data group is divided into a first gray scale data group and a second gray scale data group, that is to say, original frame signals corresponding to the pixel units are regarded as a combination of a plurality of frames; further, a gray scale of each of hues of the first gray scale data group is a maximal gray scale in the original gray scale data group; and a gray scale of each of hues of the second gray scale data group is equal to 0 or greater than a minimum gray scale in the original gray scale data group. As such, in order to highlight the dominant color and ameliorate the color cast, the gray scale data of each of hues in the original gray scale data group is displayed according to the data greater than the minimum gray scale and in the original gray scale data group, or simply not displayed; and neither of the two groups contains the data color of the minimum gray scale in the original gray scale data group, thereby reducing the brightness difference between the hue of the low gray scale of the side view angle and the hue of the overall pixel unit, such that the hue of the side view angle is presented close to the hue of the front view angle.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
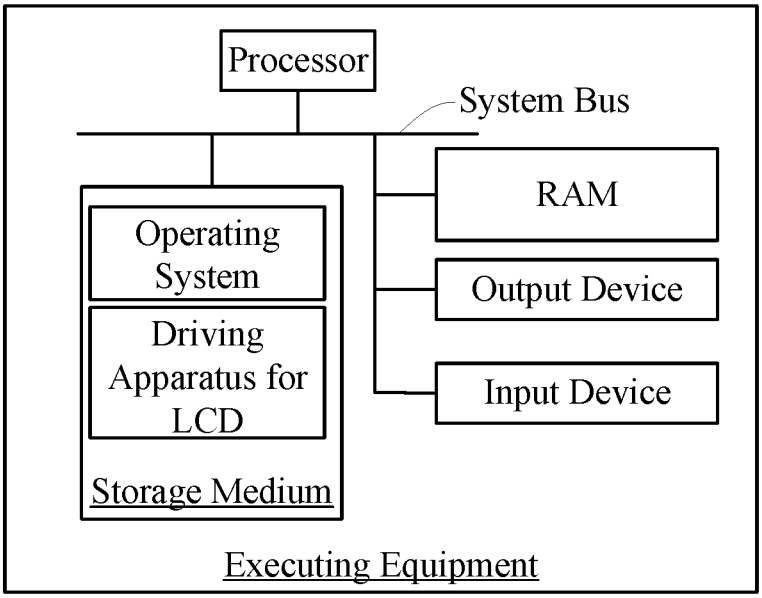
FIG. 1 is a block diagram of an executing device of a display driving method and device according to an embodiment.

The present disclosure will be described in the following with reference to the accompanying drawings and the embodiments. Preferred embodiments are provided in the drawings. The various embodiments of the disclosure may, however, be embodied in many different forms and should not be construed as limited to the specific embodiments set forth hereinafter. Numerous specific details are described hereinafter in order to facilitate a thorough understanding of the present disclosure.

FIG. 1 is a block diagram of an executing device according to an embodiment. The executing device can be a terminal that implements the display driving method. The executing device includes a processor, a storage medium, a Random-Access Memory (RAM), an output device and, an input device connected through the system bus. An operating system and an computer application program of a display driving device are stored in the storage medium. When the computer application program of the display driving device is executed by the processor, a display driving method is implemented. The processor is configured to provide computation and control capability to support the operation of the executing device. The RAM provides an environment to the computer application program of the display driving device in the storage medium, the internal storage device has stored computer-readable instructions that, when executed by at least one processors, cause the at least one processor to perform a display driving method. The output device of the executing apparatus can be a display screen, the display screen can be a displayer. The output apparatus of the executing device can be a display screen which can be a Cathode-ray Tube (CRT) display, a Plasma Display Panel (PDP) display, a Liquid Crystal Display (LCD) or other displays that can implement the driving method for display, and preferably an LCD screen. The input device can be a touch layer covered on the display screen, a button, a trackball or a touch pad configured on the shell of an electronic device, or an external keyboard, touch pad or mouse and so on. A person skilled in the art should understand, FIG. 1 is exemplary to show the structure of the terminal in accordance with an embodiment of the present disclosure and does not limit the executing apparatus to this embodiment; in other embodiments, compared with the structure shown in FIG. 1, the particular terminal may include more or less components, be configured with other components not shown in FIG. 1, or have a different configuration.

Figure 2:
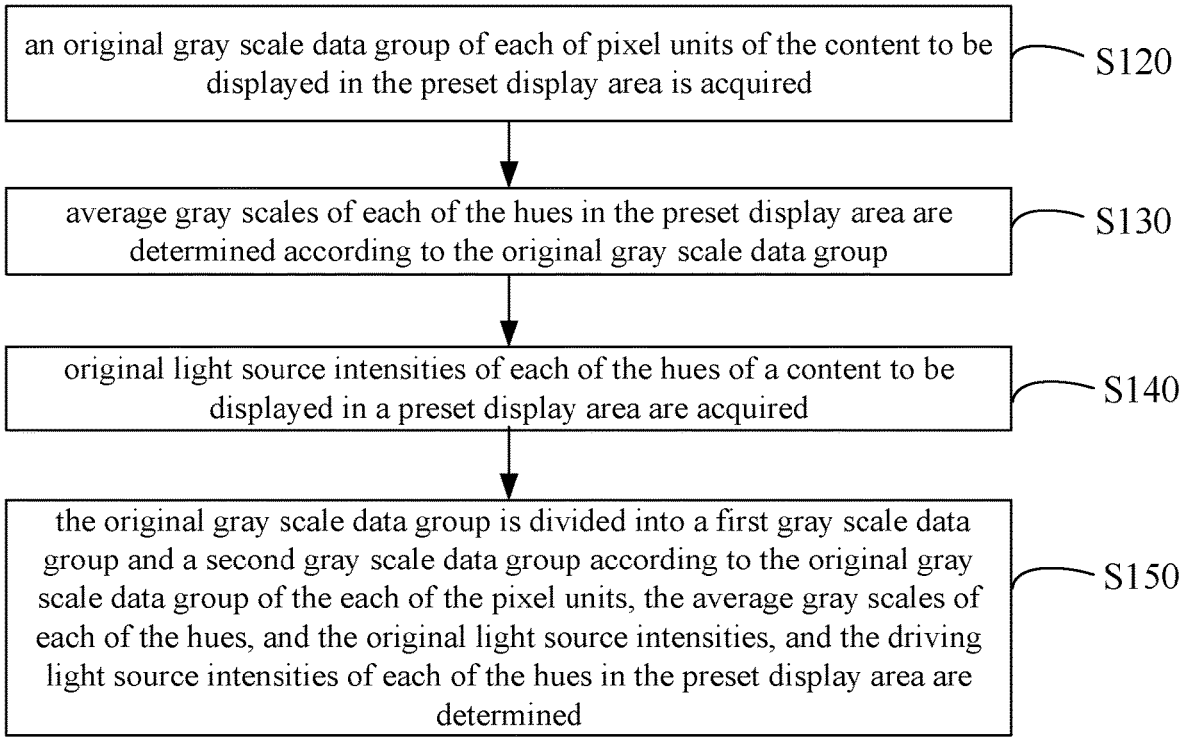
FIG. 2 is a flowchart of a display driving method according to an embodiment.

Referring to FIG. 2, a display driving method is provided, which includes:

In S120: an original gray scale data group of each of pixel units of the content to be displayed in the preset display area is acquired.

The displayer is composed with a plurality of RGB sub-pixel units, each group of RGB sub-pixels is called a pixel unit, each of which represents an image signal. The original gray scale data group of each of pixel units includes a gray scale of R, G, B three colors, for example, ($R_{n,m_i,j}$, $G_{n,m_i,j}$, $B_{n,m_i,j}$) can represent the original gray scale data group of the pixel unit at column i row j in the display area at column n row m. The display region of the displayer can be divided into a plurality of display areas, each of which includes at least two pixel units, the size of the display area is customizable, the displayer can be divided into N (columns)*M (rows) display sections composed by pixel units. Various display areas can serve as the preset display area according to a preset sequence, so as to implement the display driving method.

In S130: average gray scales of each of the hues in the preset display area are determined according to the original gray scale data group.

average gray scales of each of the hues in the preset display area can be determined according to the original gray scale data group of the pixel units in the preset display area. By respectively summing up the hues of the original gray scale data group in each of the pixel units and then dividing by the number of pixel units in the preset display area, thereby the average gray scales of each of the hues in the preset display area are obtained, which is the average gray scale group in the preset display area. For example, ($Ave_R_{n,m}$, $Ave_G_{n,m}$, $Ave_B_{n,m}$) can be used to represent the average gray scale group of the display area at column n and row m.

In S140: original light source intensities of each of the hues of a content to be displayed in a preset display area are acquired.

By way of table look-up, a table is acquired, original light source intensities of each of the hues of a content to be displayed in a preset display area are looked up in the table, original light source intensities of each of the hues of a content to be displayed in a preset display area are acquired, i.e., the original light source intensity group of the content to be displayed in the preset display area. It can be understood that the table can be pre-stored in the memory and be called when it is required; the table can also be obtained when it is required, and thereby obtaining the original light source intensity group of the content to be displayed in the preset display area. The light source intensity group of the content to be displayed at column n and row m in the display area can be represented as ($A_{n\ m_R}$, $A_{n\ m_G}$, $A_{n\ m_B}$).

In S150: the original gray scale data group is divided into a first gray scale data group and a second gray scale data group according to the original gray scale data group of the each of the pixel units, the average gray scales of each of the hues, and the original light source intensities, and the driving light source intensities of each of the hues in the preset display area are determined. A gray scale of each of the hues of the first gray scale data group is a maximal gray scale in the original gray scale data group and a gray scale of each of the hues of the second gray scale data group is equal to 0 or greater than a minimum gray scale in the original gray scale data group.

The driving light source intensities of R, G, B of the two frames may be adjusted in the preset display area according to the average gray scales (such as $Ave_R_{n,\ m}$, $Ave_G_{n,\ m}$, $Ave_B_{n,\ m}$) of the hues of each of the pixel units in the preset display. $A_{n,\ m_R}$, $A_{n,\ m_G}$, $A_{n,\ m_B}$ of the original light source intensities of the hues of R, G, B are adjusted to $A'_{n,m_R}$, $A'_{n,m_G}$, $A'_{n,m_B}$ in the display area (n, m).

According to the display driving method, the original gray scale data group is divided into a first gray scale data group and a second gray scale data group, i.e., original frame signals corresponding to the pixel units are regarded as a combination of a plurality of frames; further, a gray scale of each of the hues of the first gray scale data group is a maximal gray scale in the original gray scale data group; and a gray scale of each of the hues of the second gray scale data group is equal to 0 or greater than a minimum gray scale in the original gray scale data group. As such, in order to highlight the dominant color and ameliorate the color cast, the gray scale data of each of the hues in the original gray scale data group is displayed according to the data greater than the minimum gray scale and in the original gray scale data group, or simply not displayed; and neither of the two groups contains the data color of the minimum gray scale in the original gray scale data group, thereby reducing the brightness difference between the hue of the low gray scale of the side view angle and the hue of the overall pixel unit, such that the hue of the side view angle is presented close to the hue of the front view angle.

Figure 3:
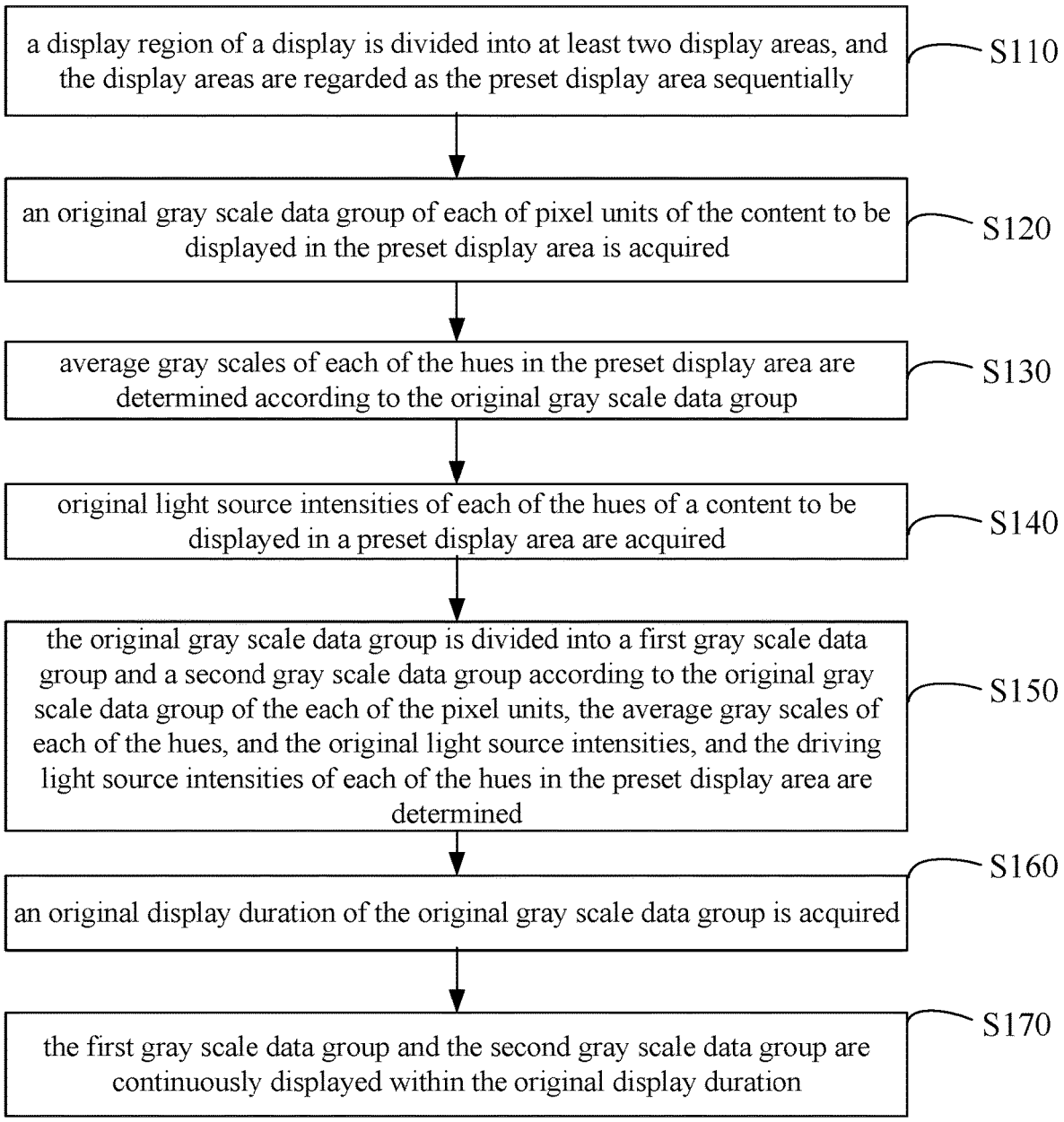
FIG. 3 is a flowchart of a display driving method according to another embodiment.

Referring to FIG. 3, in an embodiment, after a step of dividing the original gray scale data group into the first gray scale data group and the second gray scale data group, the method further includes:

In step S160: an original display duration of the original gray scale data group is acquired.

In step S170: the first gray scale data group and the second gray scale data group are continuously displayed within the original display duration.

In the present embodiment, the gray scale data group of the original frame corresponding to the first pixel unit is divided into a first gray scale data group and a second gray scale data group of two frames (a first frame and a second picture frame) corresponding to the pixel unit. The combination of the two frames is time-sequentially presented, i.e., the first gray scale data group and the second gray scale data group are displayed sequentially. The original display duration is divided into two time periods, among which the first gray scale data group is displayed in one time period, the second gray scale data group is displayed in another time period. Preferably, to ensure the display performance, the two time periods are of a same length, i.e., they are both a half of the original display duration.

Figure 4:
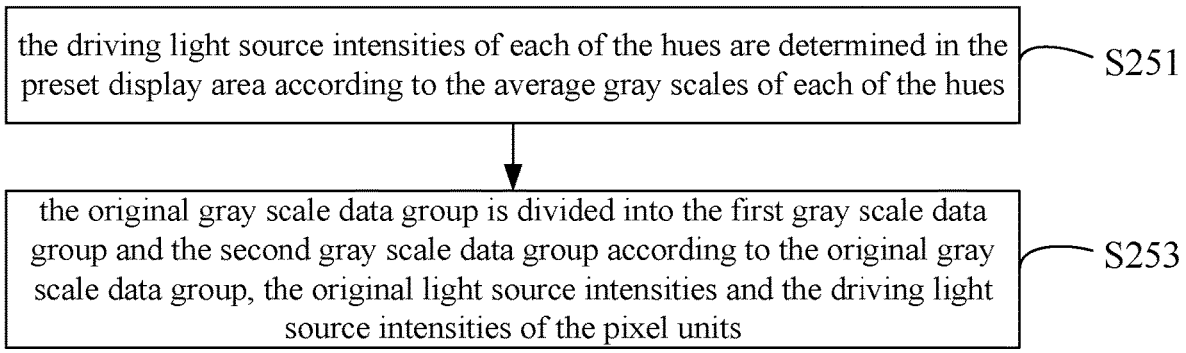
FIG. 4 is a detailed flowchart of a display driving method of FIG. 2 or FIG. 3.

Referring to FIG. 4, the step of dividing the original gray scale data group into the first gray scale data group and the second gray scale data group, according to the original gray scale data group of the pixel unit, the average gray scales of each of the hues, and the original light source intensities; and determining the driving light source intensities of each of the hues in the preset display area includes:

In S251: the driving light source intensities of each of the hues are determined in the preset display area according to the average gray scales of each of the hues.

It may be determined according to the average gray scales in the preset display area that the maximal gray scale in the average gray scales belongs to the maximal average gray scale sub-pixel dominated by which hue of R, G and B; and it is determined that the maximal gray scale of most pixel units is the hue of one sub-pixel of R, G and B in the preset display area. As such, the driving light source intensities of each of the hues can be further determined in the preset display area according to the hue corresponding to the maximal gray scale in the average gray scales of each of the hues in the preset display area.

Assuming that the average gray scales of each of the hues of each of the pixel units in the display area (n, m) are $Ave_R_{n,m}=A$, $Ave_G_{n,m}=B$, $Ave_B_{n,m}=C$, where A>B>C, so that the area is a combination of red hues.

The average gray scales $Ave_R_{n,m}$, $Ave_G_{n,m}$, $Ave_B_{n,m}$ of the hues of R, G, B are divided into two frame gray scale combinations respectively: R1G1B1 combination 1 (the first gray scale data group) and R2G2B2 combination 2 (the second gray scale data group). Where the gray scale of each of the hues in the R1G1B1 combination 1 is the maximal gray scale in the average gray scales, i.e. A; that is, R1=A, G1=A, and B1=A. The gray scale of each of hues in the R2G2B2 combination 2 is: the hue R2 corresponding to the maximal average gray scale A is equal to 0, and the gray scales of the two hues G2 and B2 is the second maximal average gray scale, i.e. B, that is, R2=0, G2=B, B2=B.

The driving light source intensities $A'_{n,m_R}$, $A'_{n,m_G}$, $A'_{n,m_B}$ of respective hues of R, G and B are calculated according to the gray scales of respective hues of the first gray scale data group and the second gray scale data group, such that the overall brightness of R, G and B signals is maintained the same as that of the original frame. The driving light source intensities $A'_{n,m_R}$, $A'_{n,m_G}$, $A'_{n,m_B}$ of respective hues of R, G and B are calculated as follows:

$$A'_{n,m_R}=2*TR(A)*A_{n,m_R}/(TR(A)+0)=2*A_{n,m_R};$$

$$A'_{n,m_G}=2*TG(B)*A_{n,m_G}/(TG(A)+TG(B));$$

$$A'_{n,m_B}=2*TB(C)*A_{n,m_B}/(TB(A)+TB(B)).$$

It should be noted that the brightness ratios corresponding to the average gray scales of respective hues of R, G and B may be obtained in the preset display area by table look-up: TR(A), TG(B) and TB(C) respectively. The brightness ratios corresponding to respective hues of the first gray scale data group can be obtained by table look-up: TR(A), TG(A) and TB(A) respectively. The brightness ratios corresponding to respective hues of the second gray scale data group can be obtained by table look-up: TR(0)=0, TG(B) and TB(B) respectively. The brightness ratio is the brightness ratio value of the gray scale of the corresponding hue with respect to the full gray scale. It can be understood that these data tables can be pre-stored in the memory, and the corresponding brightness ratios can be directly obtained when needed. The data tables can also be obtained when needed, so as to obtain the brightness ratios.

In S253: the original gray scale data group is divided into the first gray scale data group and the second gray scale data group according to the original gray scale data group, the original light source intensities and the driving light source intensities of the pixel units.

According to the maximal gray scale of each of hues in the original gray scale data group of each of pixel units, the first gray scale data group of the first frame corresponding to the pixel unit can be determined. Further in combination with the first gray scale data group, the original light intensities and the driving light source intensities, a group of brightness ratios of the gray scale of the second frame corresponding to the pixel unit after division with respect to the full gray scale can be determined according to law of brightness conservation. The group of brightness ratios includes the brightness ratio of each of hues; it can be understood that the brightness ratio is the brightness ratio value of the gray scale of the corresponding hue in relation to the full gray scale. After the two groups of brightness ratios are determined, the gray scale of each of hues in the first gray scale data group and the second gray scale data group may be determined by table look-up. It should be noted that the frame corresponding to the pixel unit includes the original frame corresponding to the pixel unit before decomposition, and the first frame and the second frame corresponding to the pixel unit after the decomposition.

Further, a step of decomposing the original gray scale data group into the first gray scale data group and the second gray scale data group according to the original gray scale data group of the pixel units, the original light source intensities and the driving light source intensities includes:

(a). a maximal gray scale of each of hues of the pixel unit is regarded as the gray scale of each of hues of the first gray scale data group.

(b). a brightness ratio of the gray scale of each of hues of the first gray scale data group in relation to a full gray scale is determined according to the gray scale of each of hues of the first gray scale data group.

(c). a brightness ratio of the gray scale of each of hues of the second gray scale data group in relation to the full gray scale is determined according to the brightness ratio of the gray scale of each of hues of the first gray scale data group in relation to the full gray scale, the original light source intensity and the driving light source intensity.

Case 1:

The average gray scales of each of the hues of all the pixel units in the display area are $Ave_R_{n,m}=A$, $Ave_G_{n,m}=B$, $Ave_B_{n,m}=C$, where A>B>C, so that the area is a combination of red hues. The original gray scale data group of most pixel units in the preset display region is represented as ($R_{n,m_i,j}=A1$, $G_{n,m_i,j}=B1$, $B_{n,m_i,j}=C1$), and most pixel units meet the combination of red hues of A1>B1>C1. In this case, the maximal gray scale in the original gray scale data group of the pixel unit $R_{i,j}$, $G_{i,j}$, $B_{i,j}$ is A1. The pixel unit is divided from 1 frame (the original frame) into a combination of 2 frames (a first frame and a second frame). After division, the gray scales of respective hues of $R_{i,j}$, $G_{i,j}$ and $B_{i,j}$ corresponds to the first gray scale data group ($R1_{i,j}$, $G1_{i,j}$, $B1_{i,j}$) and the second gray scale data group ($R2_{i,j}$, $G2_{i,j}$, $B2_{i,j}$) respectively. Where, the gray scale of each of hues of the first gray scale data group is the maximal gray scale in the original gray scale data group, i.e. A1, that is, $R_{i,j}=A1$, $G1_{i,j}=A1$, $B1_{i,j}=A1$. The brightness ratios of the gray scales of respective hue of the first gray scale data group with respect to the full gray scale may be determined by a look-up table: TR(A1), TG(A1) and TB(A1) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of hues of R, G and B in the preset display area, the brightness ratios $TR(R2_{i,j})$, $TG(G2_{i,j})$, $TB(B2_{i,j})$ of the gray scales of respective hues of the second gray scale data group with respect to the full gray scale can be determined according to the law of brightness conservation, so that the gray scale of each of hues can be further determined by a look-up table according to the brightness ratio. In one specific example, the calculation formula of the brightness ratios $TR(R2_{i,j})$, $TR(G2_{i,j})$ and $TB(B2_{i,j})$ of the gray scales of respective hues of the second gray scale data group with respect to the full gray scale is as follows:

$$TR(R2_{i,j})=(2*A_{n,m_R}*TR(A1)-A'_{n,m_R}TR(A1))/A'_{n,m_R}=0;$$

$$TG(G2_{i,j})=(2*A_{n,m_G}*TG(B1)-A'_{n,m_G}*TG(A1)))/A'_{n,m_G}=((TG(A)+TG(B))/TG(B))*TG(B1)-TG(A1);$$

$$TB(B2_{i,j})=(2*A_{n,m_B}*TB(C1)-A'_{n,m_B}*TB(A1))/A'_{n,m_B}=((TB(A)+TB(B))/TB(C))*TB(C1)-TB(A1).$$

Case 2:

The average gray scales of each of the hues of all the pixel units in the display area are $Ave_R_{n,m}=A$, $Ave_G_{n,m}=B$, $Ave_B_{n,m}=C$, where A>B>C, so that the area is a combination of red hues. If the original gray scale data group of other pixel units is present in the preset display area as ($R'_{i,j}=A2$, $G'_{i,j}=B2$, $B'_{i,j}=C2$), the pixel unit is a combination of green hues of B2>C2>A2, which is different from the size order of the average gray scales of the preset display area. The gray scales of each of the hues of the pixel unit $R'_{i,j}$, $G'_{i,j}$, $B'_{i,j}$ is divided from 1 frame (an original frame) into a combination of two frames (a first frame and a second frame) corresponding to the first gray scale data group ($R'1_{i,j}$, $G'1_{i,j}$, $B'1_{i,j}$) and the second gray scale data group ($R'2_{i,j}$, $G'2_{i,j}$, $B'2_{i,j}$) respectively. Where, the gray scale of each of hues of the first gray scale data group is the maximal gray scale in the original gray scale data group, i.e. B2, that is, $R'1_{i,j}=B2$, $G'1_{i,j}=B2$, $B'1_{i,j}=B2$. The brightness ratios of the gray scales of respective hue of the first gray scale data group with respect to the full gray scale may be determined by a look-up table: TR (B2), TG (B2) and TB (B2) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of hues of R, G and B in the preset display area, the brightness ratios TR ($R'2_{i,j}$), TG ($G'2_{i,j}$), TB ($B'2_{i,j}$) of the gray scales of respective hues of the second gray scale data group with respect to the full gray scale can be determined according to law of brightness conservation, so that the gray scale of each of hues can be further determined by a look-up table according to the brightness ratio. In one specific example, the calculation formula of the brightness ratios $TR(R'2_{i,j})$, $TR(G'2_{i,j})$ and $TB(B'2_{i,j})$ of the gray scales of respective hues of the second gray scale data group with respect to the full gray scale is as follows:

$$TR(R'2_1)=(2*A_{n,m_R}*TR(A2)-A'_{n,m_R}*(TR(B2)))/A'_{n,m_R}=TR(A2)-TR(B2),\quad \text{if}\quad TR(R'2_{i,j})>Y, TR(R'2_{i,j})=Y, \text{ if } TR(R'2_{i,j})<0, TR(R'2_{i,j})=0;$$

$$TG(G'2_{i,j})=(2*A_{n,m_G}*TG(B2)-A'_{n,m_G}*(TG(B2)))/A'_{n,m_G}=((TG(A)+TG(B))/TG(B))*TG(B2)-TG(B2), \text{ if } TG(G'2_{i,j})>Y, TG(G'2_{i,j})=Y, \text{ if } TG(G'2_{i,j})<0, TG(G'2_{i,j})=0;$$

$$TB(B'2_{i,j})=(2*A_{n,m_B}*TB(C2)-A'_{n,m_B}*(TB(C2)))/A'_{n,m_B}=((TB(A)+TB(B))/TB(C))*TB(C2)-TB(B2), \text{ if } TB(B'2_{i,j})>Y, TB(B'2_{i,j})=Y, \text{ if } TB(B'2_{i,j})<0, TB(B'2_{i,j})=0.$$

It should be noted that since the size order of the original gray scale data group of the pixel unit is different from that of the average gray scales of the preset display region, the brightness ratios of the gray scales of respective hues of the second gray scale data group ($R'1_{i,j}$, $G'1_{i,j}$, $B'1_{i,j}$) corresponding to the pixel unit with respect to the full gray scale may be determined by the above formula, and then the brightness ratio may be lower than 0 or greater than a preset maximal value. Therefore, it should be required to determine values of the calculated brightness ratios $TR(R'2_{i,j})$, $TG(G'2_{i,j})$ and $TB(B'2_{i,j})$ of the gray scales of respective hues of the second gray scale data group with respect to the full gray scale. If the value is less than 0, the brightness ratio is set up to be 0; and if the value is greater than the preset maximal value Y, the brightness ratio is set as the preset maximal value Y.

Referring to FIG. 3, in an embodiment, prior to the step of acquiring the original gray scale data group of each of pixel units of the content to be displayed in a preset display area, the method further includes:

S110: a display region of a display is divided into at least two display areas, and the display areas are regarded as the preset display area sequentially.

Each of the display areas can serve as the preset display area according to a preset sequence, so as to implement the display driving. The preset sequence can be a sequence where a row sorting is first performed prior to a column sorting, or a sequence where a column sorting is performed prior to a row sorting. As such, the display driving is performed to various display areas of the entire displayer, thereby implementing the display driving for the entire displayer.

In an embodiment, the step of dividing the original gray scale data group into the first gray scale data group and the second gray scale data group, according to the original gray scale data group of the each of pixel units, the average gray scales of each of the hues, and the original light source intensities; and determining the driving light source intensities of each of the hues in the preset display area includes: if the gray scales of respective hues in the preset display area are the same original gray scale data group, the average gray scales of respective hues are the gray scales of respective hues of the original gray scale data group. In this case, the original gray scale data group is divided into the first gray scale data group and the second gray scale data group, where the gray scale of each of hues of the first gray scale data group is the maximal gray scale in the original gray scale data group, and the gray scale of each of hues of the second gray scale data group is 0 or the second maximal gray scale in the original gray scale data group; the driving light source intensities of the hues in the preset display area is determined according to the original light source intensities, the first gray scale data group and the second gray scale data group.

As an specific example, when all the gray scales of each of the hues in the preset display area are red hue combinations that R=100, G=80, B=40, the original gray scale data group of the original frame corresponding to the pixel unit is divided into the first gray scale data group (R1, G1, B1) and the second gray scale data group (R2, G2, B2) of the two frames corresponding to the pixel unit. Where the gray scales of each of the hues in the first gray scale data group are the maximal gray scale in the original gray scale data group, i.e., 100, which is R1=100, G1=100, B1=100. The gray scales of each of the hues in the second gray scale data group are the gray scales of each of the hues that are 0, or the second maximal gray scales in the original gray scale data group, particularly, R2=0, G2=80, B2=80. The original gray scale data group is divided into two gray scale data groups, the two gray scale data groups are time-sequentially presented. That is, the original display duration of the original frame is required to be equally divided into three time periods, where one time period presents the first gray scale data group and another time period presents the second gray scale data group.

Assuming the brightness ratios of the front view of the original gray scale data group ($R_{i,j}$=100, $G_{i,j}$=80, $B_{i,j}$=40) of a pixel unit over a full gray scale 255 are SR %, LG %, MB %, correspondingly, the side view brightness ratios are SR'%, LG'%, MB'%, where SR>LG>MB and SR'>LG'>MB'. Since the front view and side view brightness ratio difference is greater as the gray scale signal is lower, it can be understood that SR/MB>SR'/MB' and LG/MB>LG'/MB', the color is mixed such that the brightness ratio of the primary brightness signal SR at the front view is greater than that of MB in terms of difference, still, in the case of side view, the brightness ratio of the primary brightness signal SR' is less than that of MB' in terms of difference, the color brightness is reduced as the dominant hue color of the front view is affected. In view of the optical-electrical characteristics of prior VA displays, the brightness variation corresponding to a standard signal is a relation conforming to an exponent 2.2. For example, Y=(X/255)2.2, Y is a normalization brightness, X is a gray scale (a preferred gray scale is a 8 bit signal between 0 and 255), by way of table look-up or that the brightness variation corresponding to the above signal is a relation conforming to the exponent 2.2, it can be determined that SR %=13.3%, LG %=7.4%, MB=1.7%, SR'%=39%, LG'%=34.7%, MB'=23.1%.

As all the gray scales of the first gray scale data group are 100, by way of table look-up, it can be determined that the front view brightness ratios of each of the hues of the first picture frame are respectively: 13.3%, 12.1%, 12.1%, and the side view brightness ratios are respectively: 39%, 41%, 49%. As to the second gray scale data group ($R2_{i,j}$=0, $G2_{i,j}$=80, $B2_{i,j}$=80), by way of table look-up, it can be determined that the front view brightness ratios of each of the hues of the second frame are respectively: 0%, 7.4%, 7.4%, and the side view brightness ratios are respectively: 0%, 34.7%, 42.1%.

Since the original one frame is changed, time-sequentially, from one frame to two frames, the frame frequency of the displayer shall be increased by one time, and the displaying duration for each of the frame is ½ of the original display duration. Assuming the original display duration of the original frame signal is T, then it is divided and is a sum of the durations of two frames time-sequentially, as each of the frame durations after division is ½ of the original frame signal, the driving light source intensities of the time-sequentially divided two frames must therefore be cooperatively increased by one time, i.e., the driving light source intensities of each of the hues of R, G, B must be increased to be twice as much the original light source intensity, such that the overall brightness is maintained to be the same as the original frame signal. For hue R, the original light source intensity is A_R, the driving light source intensity should be increased to be twice the original light source intensity, i.e., the backlight brightness must be A'_R=2*A_R, further, as for the brightness ratio of hue G and hue B, TG(G1)+TG(G2)=TG(100)+TG(80)=13.3%+7.4%=20.7% is greater than the hue original brightness ratio TG(80)=7.4%, and TB(B1)+TB(B2)=TB(100)+TB(80)=12.1%+7.4%=19.5% is greater than the original brightness ratio TB(40)=1.7% of hue B. As such, the brightness conservation of the front view of hues G, B can only be maintained with assistance by adjusting the driving light source intensities of hues G, B, therefore, A'_G=2*A_G*TG(80)/(TG(100)+TG(80))=0.715*A_G, likewise, A'_B=2*A_B*TB(40)/(TB(100)+TB(80))=0.174*A_B.

As the comprehensive brightness ratios of the combination of the side view frame 1 and frame 2 at each of the hues $R_{i,j}$, $G_{i,j}$, $B_{i,j}$ are respectively (39%+0%)*2=78%, (41%+34.7%)*0.715=54.1%, (49%+42.1%)*0.174=15.9%; while brightness ratios of each of the hues $R_{i,j}$, $G_{i,j}$, $B_{i,j}$ of the side view of the original frame are respectively 39%, 34.7%, 23.1%, accordingly, brightness ratio of the dominant hue R in relation to hue B is increased from 39%/23.1%=1.696 of the original picture frame to 78%/15.9%=4.9 of the combined picture frame, likewise, the value of the brightness ratio of the dominant hue R to hue G is increased from 39%/34.7%=1.127 of the original picture frame to 78%/54.1%=1.44 of the combined picture frame, such combined frames lowered the equivalent brightness in large viewing angle of low gray scale of the original frame, such that the dominant hue is remarkably escalated in relation to other hues, such that the side view is relatively close to the presentation of the dominant hue of the front view. It should be noted that, the dominant hue is the hue corresponding to the maximal gray scale in the original gray scale data group corresponding to the pixel unit.

Figure 5:
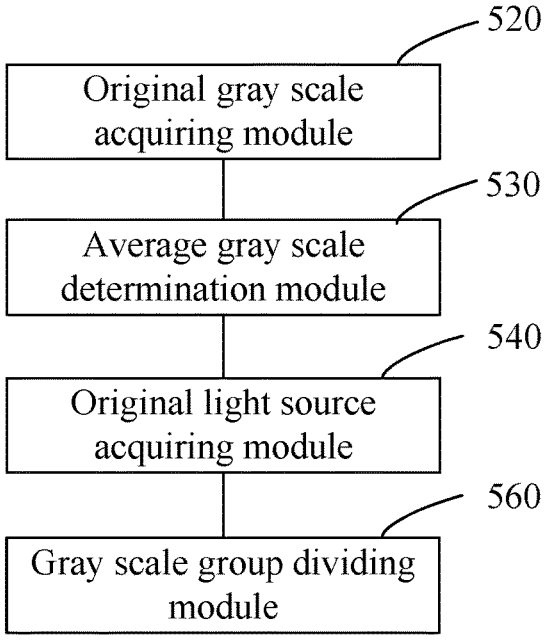
FIG. 5 is a block diagram of a display driving device according to an embodiment.

Referring to FIG. 5, a display driving device corresponding to foregoing method is also provided herein, which includes:

An original gray scale acquiring module 520 configured to acquire an original gray scale data group of each of the pixel units of the content to be displayed in the preset display area;

An average gray scale determination module 530 configured to determine average gray scales in the preset display area according to the original gray scale data group;

An original light source acquiring module 540 configured to acquire original light source intensities of each of the hues of a content to be displayed in a preset display area;

A gray scale group dividing module 560 configure to, according to the original gray scale data group of the pixel units, the average gray scales of each of the hues, the original light source intensities, divide the original gray scale data group into a first gray scale data group and a second gray scale data group; and the driving light source intensities of each of the hues in the preset display area are determined; the gray scales of each of the hues of the first gray scale data group are the maximal gray scale in the original gray scale data group; the gray scales of each of the hues of the second gray scale data group is 0 or greater than the minimal gray scale of the original gray scale data group.

According to the display driving device, the original gray scale data group is divided into a first gray scale data group and a second gray scale data group, that is to say, original frame signals corresponding to the pixel units are regarded as a combination of a plurality of frames; further, a gray scale of each of hues of the first gray scale data group is a maximal gray scale in the original gray scale data group; and a gray scale of each of hues of the second gray scale data group is equal to 0 or greater than a minimum gray scale in the original gray scale data group. As such, in order to highlight the dominant color and improve the color shift, the gray scale data of each of hues in the original gray scale data group is displayed according to the data greater than the minimum gray scale in the original gray scale data group, or simply not displayed; and both groups do not contain the data color of the minimum gray scale in the original gray scale data group, thereby reducing the brightness difference between the hue of the low gray scale of the side view angle and the hue of the overall pixel unit, such that the hue of the side view angle appears close to the presentation of the hue of the front view angle and achieve an image presentation with low color cast.

Figure 6:
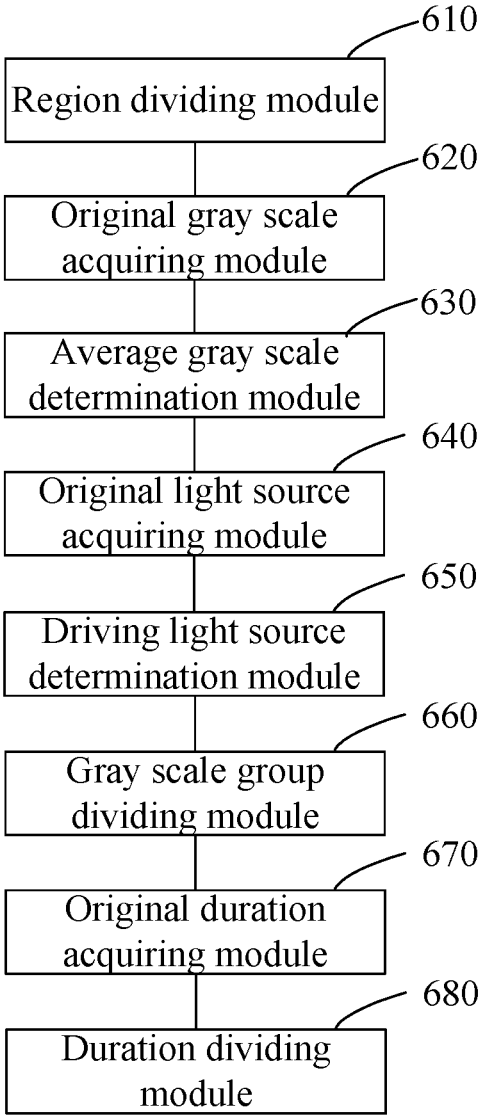
FIG. 6 is a block diagram of a display driving device according to another embodiment.

Referring to FIG. 6, in an embodiment, the device further includes:

An original duration acquiring module 670 configured to acquire an original display duration of the original gray scale data group;

A duration dividing module 680 configured to continuously display the first gray scale data group and the second gray scale data group within the original display duration.

Continue the reference to FIG. 6, in an embodiment, the device further includes a driving light source determination module 650;

The driving light source determination module 650 is configured to determine the driving light source intensities of each of the hues in the preset display area according to the average gray scales of each of the hues.

The gray scale group division module 660 is configured to divide the original gray scale data group into a first gray scale data group and a second gray scale data group according to the original gray scale data, the original light source intensities and the driving light source intensities of each of the pixel units.

Figure 7:
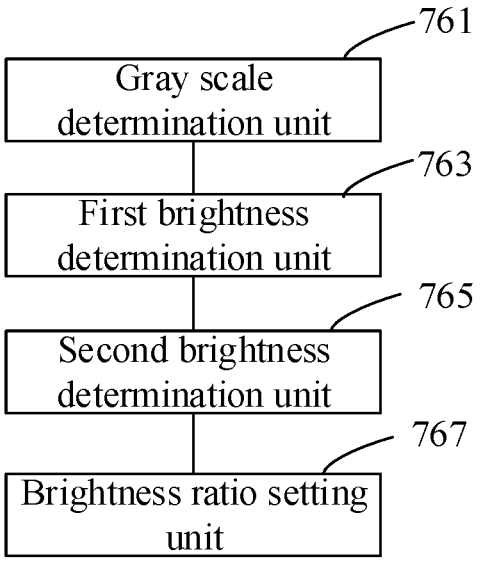
FIG. 7 is a block diagram of a module of a display driving device in FIG. 5 or FIG. 6.

Referring to FIG. 7, in an embodiment, the gray scale group dividing module includes:

A gray scale determination unit 761 configured to regarding the maximal gray scales of each of the hues of the pixel unit as the gray scales of each of the hues in the first gray scale data group;

A first brightness determination unit 763 configured to determine the brightness ratios of the gray scales of each of the hues in the first gray scale data group with respect to the full gray scale according to the gray scales of each of the hues of the first gray scale data group;

A second brightness determination unit 765 configured to determine the brightness ratios of the gray scales of each of the hues in the second gray scale data group with respect to the full gray scale according to the brightness ratios of the gray scales of each of the hues in the first gray scale data group with respect to the full gray scale, original light source intensities and the driving light source intensities.

Continue the reference to FIG. 6, in an embodiment, the device further includes:

A region dividing module 610 configured to divide the display region of the displayer into at least two display areas and sequentially regard the display areas as the preset display area.

Referring FIG. 7, in an embodiment, the gray scale group dividing module further includes: a brightness ratio setting unit 767 configured to set the brightness ratios according to the brightness ratios of the gray scales of each of the hues in the second gray scale data group with respect to the full gray scale.

Continue the reference to FIG. 6, in an embodiment, the driving light source determination module 650 further includes a driving light source calculation unit configured to calculate the driving light source intensities $A'_{n,m_R}$, $A'_{n,m_G}$, $A'_{n,m_B}$ of respective hues of R, G, B.

Continue the reference to FIG. 6, in an embodiment, the duration dividing module 680 further includes a duration control unit configured to control the display durations of the first gray scale data group and the second gray scale data group.

Continue the reference to FIG. 6, in an embodiment, the original light source acquiring module 540 includes a table look-up unit configured to acquire the table, look up in the table the original light source intensities of each of the hues in the preset display area, and acquire the original light source intensity group of the content to be displayed in the preset display area.

A computer apparatus corresponding to the foregoing method is also provided.

A computer apparatus includes a memory, a processor and a computer program stored in the memory and executable on the processor, the processor executes the computer program to provide steps of the foregoing display driving method.

As the foregoing display driving device and display driving method are corresponding to each other, with respect to the specific technical features of the device and corresponding to the foregoing method are omitted for brevity. As the foregoing computer apparatus is corresponding to the display driving method, with respect to the specific technical features of the device and corresponding to the foregoing method are also omitted for brevity.

A person skilled in the art should understand that the processes of the methods in the above embodiments can be, in full or in part, implemented by computer programs instructing underlying hardware, the programs can be stored in a non-volatile computer-readable storage medium, such as in the embodiments of the present disclosure, the program can be stored in the storage medium of the computer system and be executed by at least one processor of the computer system to implement the processes in the embodiments of the various foregoing display driving methods.

In an embodiment, a storage medium is also provided, a computer program is stored thereon, the program is executed to implement any of the display driving methods in the various foregoing embodiments. The storage medium can be a disk, a Compact Disk (CD), a Read-Only Memory (ROM), or a Random Access Memory (RAM).

According to the computer storage medium and the computer program stored thereon, by implementing the processes of the embodiments of the various foregoing display driving method, in order to highlight the dominant color and ameliorate the color cast, the gray scale data of each of hues in the original gray scale data group is displayed according to the data greater than the minimum gray scale and in the original gray scale data group, or simply not displayed; and neither of the two groups contains the data color of the minimum gray scale in the original gray scale data group, thereby reducing the brightness difference between the hue of the low gray scale of the side view angle and the hue of the overall pixel unit, such that the hue of the side view angle is presented close to the hue of the front view angle.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A display driving method, comprising:

acquiring an original gray scale data group of each of pixel units of a content to be displayed in a preset display area;

determining an average gray scale of each of hues in the preset display area according to the original gray scale data group;

acquiring an original light source intensity of each of the hues of the content to be displayed in the preset display area;

wherein the step of acquiring the original light source intensity of each of the hues of the content to be displayed in the preset display area comprises: acquiring a table; looking up the original light source intensities of each of the hues of the content to be displayed in the preset display area in the table; and acquiring original light source intensities of each of the hues of the content to be displayed in the preset display area;

dividing the original gray scale data group into a first gray scale data group and a second gray scale data group according to the original gray scale data group of the pixel units, the average gray scales of each of the hues, and the original light source intensities, and determining the driving light source intensities of each of the hues in the preset display area, wherein said dividing and determining comprises;

determining the driving light source intensities of each of the hues in the preset display area according to the average gray scales of each of the hues; and dividing the original gray scale data group into the first gray scale data group and the second gray scale data group according to the original gray scale data group, the original light source intensities, and the driving light source intensities of each of the pixel units; and wherein a gray scale of each of the hues of the first gray scale data group is a maximal gray scale in the original gray scale data group; and wherein a gray scale of each of the hues of the second gray scale data group is 0 or greater than a minimal gray scale of the original gray scale data group.

2. The display driving method according to claim 1, wherein after the step of dividing the original gray scale data group into the first gray scale data group and the second gray scale data group, the method further comprises:

acquiring an original display duration of the original gray scale data group; and displaying the first gray scale data group and the second gray scale data group continuously within the original display duration.

3. The display driving method according to claim 1, wherein the step of dividing the original gray scale data group into the first gray scale data group and the second gray scale data group according to the original gray scale data group, the original light source intensities and the driving light source intensities of each of the pixel units comprises:

regarding a maximal gray scale of each of the hues of the pixel units as the gray scale of each of the hues of the first gray scale data group;

determining brightness ratios of the gray scales of each of the hues of the first gray scale data group with respect to a full gray scale according to the gray scales of each of the hues of the first gray scale data group; and determining the brightness ratios of the gray scales of each of the hues of the second gray scale data group with respect to the full gray scale according to the brightness ratios of the gray scales of each of the hues of the first gray scale data group with respect to the full gray scale, the original light source intensities and the driving light source intensities.

4. The display driving method according to claim 1, wherein the step of dividing the original gray scale data group into the first gray scale data group and the second gray scale data group and determining the driving light source intensities of each of the hues in the preset display area according to the original gray scale data group of each of the pixel units, the average gray scales of each of the hues, and the original light source intensities comprises:

regarding the average gray scales of each of the hues as the gray scales of each of the hues of the original gray scale data group when each of the gray scales of each of the hues in the preset display area are the same original gray scale data group, and dividing the original gray scale data group into the first gray scale data group and the second gray scale data group.

5. The display driving method according to claim 3, wherein when the brightness ratios of the gray scales of each of the hues of the second gray scale data group with respect to a full gray scale is less than 0, the brightness ratios are set up to be 0.

6. The display driving method according to claim 3, wherein when the brightness ratios of the gray scales of each of the hues of the second gray scale data group with respect to the full gray scale is greater than a preset maximal value, the brightness ratios are set up to be a preset maximal value.

7. The display driving method according to claim 2, wherein the display duration of each of the first gray scale data group and the second gray scale data group is a half of the original display duration.

8. The display driving method according to claim 1, wherein the driving light source intensities $A'_{n,m_R}$, $A'_{n,m_G}$, $A'_{n,m_B}$ of respective hues of R, G and B are calculated according to the gray scales of respective hues of the first gray scale data group and the second gray scale data group, such that the overall brightness of R, G and B signals is maintained the same as that of the original frame, the calculation formula of the driving light source intensities $A'_{n,m_R}$, $A'_{n,m_G}$, $A'_{n,m_B}$ of the respective hues of R, G and B are:

$$A'_{n,m_R}=2*TR(A)*A_{n,m_R}/(TR(A)+0)=2*A_{n,m_R};$$

$$A'_{n,m_G}=2*TG(B)*A_{n,m_G}/(TG(A)+TG(B));$$

$$A'_{n,m_B}=2*TB(C)*A_{n,m_B}/(TB(A)+TB(B));$$

wherein TR(A), TG(B) and TB(C) are brightness ratios corresponding to the average gray scales of each of the hues R, G, B in the preset display area, $A_{n,m_R}$, $A_{n,m_G}$, $A_{n,m_B}$ are original light source intensities of the respective hues R, G, B.

9. The display driving method according to claim 1, wherein prior to the step of acquiring the original gray scale data group of each of the pixel units of the content to be displayed in the preset display area, the method further comprises:

dividing a display region of a displayer into at least two display areas and regarding the display areas as the preset display area sequentially.

10. A display driving device, comprising:

an original gray scale acquiring module configured to acquire an original gray scale data group of each of pixel units of a content to be displayed in a preset display area;

an average gray scale determination module configured to determine average gray scales in the preset display area according to the original gray scale data group;

an original light source acquiring module configured to acquire original light source intensities of each of hues of the content to be displayed in the preset display area; and a driving light source determination module:

wherein a gray scale group dividing module configured to divide the original gray scale data group into a first gray scale data group and a second gray scale data group according to the original gray scale data group of each of the pixel units, the average gray scales of each of the hues, and the original light source intensities, and determine the driving light source intensities of each of the hues in the preset display area; and the gray scales of each of the hues of the first gray scale data group are a maximal gray scale in the original gray scale data group; the gray scales of each of the hues of the second gray scale data group are 0 or greater than a minimal gray scale of the original gray scale data group, wherein the driving light source determination module is configured to determine the driving light source intensities of each of the hues in the preset display area according to the average gray scales of each of the hues; and wherein the gray scale group dividing module is configured to divide the original gray scale data group into a first gray scale data group and a second gray scale data group according to the original gray scale data, the original light source intensities, and the driving light source intensities of each of the pixel units.

11. The display driving device according to claim 10, wherein the device further comprises:

an original duration acquiring module configured to acquire an original display duration of the original gray scale data group; and a duration dividing module configured to continuously display the first gray scale data group and the second gray scale data group within the original display duration.

12. The display driving device according to claim 10, wherein the gray scale group dividing module further comprises:

a gray scale determination unit configured to regarding the maximal gray scales of each of the hues of the pixel units as the gray scales of each of the hues in the first gray scale data group;

a first brightness determination unit configured to determine brightness ratios of the gray scales of each of the hues in the first gray scale data group with respect to a full gray scale according to the gray scales of each of the hues of the first gray scale data group; and a second brightness determination unit configured to determine the brightness ratios of the gray scales of each of the hues in the second gray scale data group with respect to the full gray scale according to the brightness ratios of the gray scales of each of the hues in the first gray scale data group with respect to the full gray scale, original light source intensities and the driving light source intensities.

13. The display driving device according to claim 10, wherein the device further comprises:

a region dividing module configured to divide a display region of an displayer into at least two display areas and sequentially regard the display areas as the preset display area.

14. The display driving device according to claim 10, wherein the driving light source determination module further comprises a driving light source calculation unit configured to calculate the driving light source intensities $A'_{n,m_R}$, $A'_{n,m_G}$, $A'_{n,m_B}$ of respective hues of R, G, B.

15. The display driving device according to claim 12, wherein the gray scale group dividing module further comprises a brightness ratio setting unit configured to set up the brightness ratios according to the brightness ratios of the gray scales of each of the hues in the second gray scale data group with respect to the full gray scale.

16. The display driving device according to claim 11, wherein the duration dividing module further comprises a duration control unit configured to control the display durations of the first gray scale data group and the second gray scale data group.

17. The display driving device according to claim 10, wherein the original light source acquiring module comprises a table look-up unit configured to acquire a table, look up in the table the original light source intensities of each of the hues in the preset display area, and acquire the original light source intensity group of the content to be displayed in the preset display area.

18. A computer apparatus comprising a memory, a processor and a computer program stored in the memory and executable on the processor, the processor executes the computer program to provide steps of the display driving method according to claim 1.

* * * * *